US009482083B2

(12) United States Patent
Doris

(10) Patent No.: US 9,482,083 B2
(45) Date of Patent: Nov. 1, 2016

(54) CONTROLLING VIBRATIONS IN A DRILLING SYSTEM

(75) Inventor: Apostolos Doris, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 454 days.

(21) Appl. No.: 13/996,463

(22) PCT Filed: Dec. 20, 2011

(86) PCT No.: PCT/EP2011/073325
§ 371 (c)(1),
(2), (4) Date: Jun. 20, 2013

(87) PCT Pub. No.: WO2012/084886
PCT Pub. Date: Jun. 28, 2012

(65) Prior Publication Data

US 2013/0277110 A1 Oct. 24, 2013

(30) Foreign Application Priority Data

Dec. 22, 2010 (EP) ..... 10196478

(51) Int. Cl.
*G06G 7/48* (2006.01)
*E21B 44/00* (2006.01)

(52) U.S. Cl.
CPC ..... *E21B 44/00* (2013.01)

(58) Field of Classification Search
CPC ..... E21B 44/00; E21B 47/01
USPC ..... 703/10; 725/25, 45; 702/6
See application file for complete search history.

(56) References Cited

U.S. PATENT DOCUMENTS 4,760,735 A * 8/1988 Sheppard ..... E21B 44/00 702/41
5,117,926 A 6/1992 Worrall et al. ..... 175/56
8,042,623 B2 * 10/2011 Quernheim ..... E21B 44/00 175/26

(Continued)

FOREIGN PATENT DOCUMENTS

EP 443689 2/1991 ..... E21B 41/00
WO EP1114240 3/2000 ..... E21B 44/00
WO WO2010063982 6/2010 ..... E21B 44/00

OTHER PUBLICATIONS

PCT International Search Report, Application No. PCT/EP2011/073386 dated Jan. 30, 2012.

(Continued)

*Primary Examiner* — Eunhee Kim

(57) ABSTRACT

A method for controlling vibrations in a drilling system, the drilling system including an elongate body extending from surface into a borehole formed in an earth formation, and an associated drive system for driving the elongate body, the drive system comprising a torque controller, the method comprising obtaining a model of the drilling system; obtaining at least one input parameter for the model that relates to an uphole parameter of the drilling system; operating the drive system to provide a drive torque to the elongated body; obtaining at least one output parameter from applying the model using the at least one input parameter, the at least one output parameter including at least one modelled downhole parameter of rotational motion; using the modelled downhole parameter of rotational motion in the torque controller for determining an adjustment to the drive torque, so as to control vibrations; as well as a drilling system comprising a torque controller, which torque controller is adapted to use the modelled downhole parameter of rotational motion for determining an adjustment to the drive torque.

13 Claims, 5 Drawing Sheets

(56) References Cited

U.S. PATENT DOCUMENTS

Figure 1:
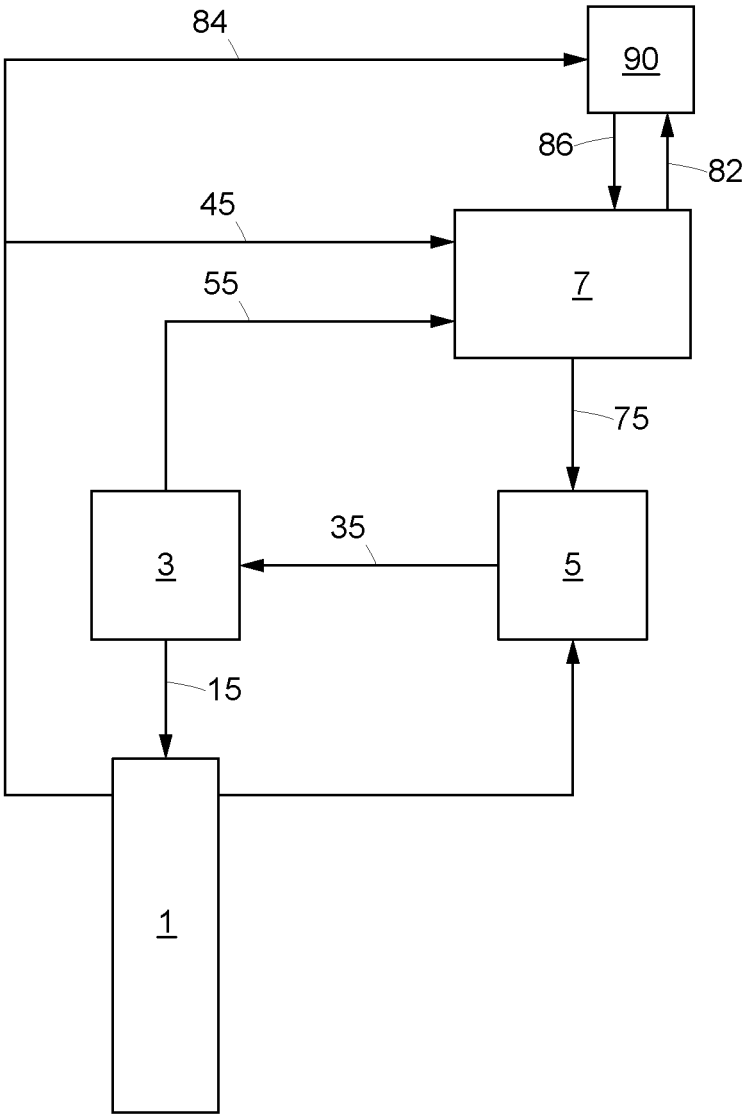

2011/0232966 A1* 9/2011 Kyllingstad ..... E21B 44/00 175/24
2011/0245980 A1* 10/2011 Nessjoen ..... E21B 44/00 700/280

OTHER PUBLICATIONS

A. Doris, Output-feedback design for non-smooth mechanical systems: Control synthesis and experiments, Ph.D. thesis. Eindhoven University of Technology, Sep. 2007.

* cited by examiner

CONTROLLING VIBRATIONS IN A DRILLING SYSTEM

PRIORITY CLAIM

The present application claims priority from PCT/EP2011/073325, filed Dec. 20, 2011, which claims priority from European application 10196478.1, filed Dec. 22, 2010, which is incorporated herein by reference.

The present invention relates to a drilling system and to a method for controlling vibrations in a drilling system.

Numerous vibrations may occur in elongate bodies, such as in borehole equipment used in a wellbore into the earth, e.g. in the context of the drilling for or production of hydrocarbons from a subsurface formation.

Drilling an oil and/or gas well is typically done by rotary drilling, so as to create a wellbore, which can have vertical parts and/or parts deviating from the vertical, e.g. horizontal sections.

In rotary drilling, typically a drill string comprising a drill bit at its downhole end is used, wherein the main length of drill string is formed by lengths of drill pipe that are screwed together. The drill string is rotated by a drive system, e.g. a top drive or rotary table, providing torque to the drill string at or near the surface. The drill string is to transmit the rotation to the drill bit, while typically also providing weight on bit as well as drilling fluid through the drill string, thereby extending the borehole. The drive system can e.g. be a top drive or rotary table.

A drill string can be several kilometres long, e.g. up to 10 km, 20 km, or even more, and is thus a very long elongate body compared to its diameter. It will be twisted several turns during drilling. Different vibrations may be induced during drilling, e.g. rotational, torsional, lateral and/or longitudinal (axial) vibrations, by alternating slip-stick motions of the drill string alongside the borehole wall, by fluctuating bit-rock interaction forces and by pressure pulses in the drilling fluid generated by the mud pumps.

In a model description, a drillstring can often be regarded so as to behave as a torsional pendulum i.e. the top of the drill string rotates with a certain angular velocity, whereas the drill bit performs a rotation with varying angular velocity. The varying angular velocity can have a constant part and a superimposed torsional vibrational part. In extreme cases, the bit periodically comes to a complete standstill. Maintaining rotation of the drill string at surface builds up torque and eventually causes the drill bit to suddenly rotate again, initially typically at an angular velocity that is much higher than the angular velocity at the surface. The velocity is dampened again, and the process can repeat so as to cause an oscillating behaviour. This phenomenon is known as stick-slip.

It is desirable to prevent these vibrations, such as in order to reduce shock loads to the equipment, excessive bit wear, premature tool failures and poor drilling rate. High peak speeds occurring during in the slip phase can lead to secondary effects like extreme axial and lateral accelerations and forces.

To suppress the stick-slip phenomenon, control methods and systems have been applied in the art to control the speed of the drive system such that the rotational speed variations of the drill bit are dampened or prevented.

One such method and system is disclosed in EP-B-443689, in which the energy flow through the drive system of the drilling assembly is controlled to be between selected limits, the energy flow being definable as the product of an across-variable and a through-variable. The speed fluctuations are reduced by measuring at least one of the variables and adjusting the other variable in response to the measurement.

In EP-B-1114240 it is pointed out that the control system known from EP-B-443689 can be represented by a combination of a rotational spring and a rotational damper associated with the drive system. To obtain optimal damping, the spring constant of the spring and the damping constant of damper are to be tuned to optimal values, and the rotational stiffness of the drill string plays an important role in tuning to such optimal values. To aid this tuning, EP-B-1114240 therefore discloses a method and system for determining the rotational stiffness of a drill string for drilling of a borehole in an earth formation.

WO 2010/063982 discloses a method and system for dampening stick-slip operations, wherein the rotational speed is controlled using a PI controller that is tuned such that the drilling mechanism absorbs torsional energy at or near the stick-slip frequency. The method can also comprise the step of estimating a bit speed, which is the instantaneous rotational speed of a bottom-hole assembly. The bit speed is displayed at a driller's graphical interface and is regarded as a useful optional feature to help the driller visualize what is happening downhole.

A basic control theory for a non-smooth mechanical systems is described in A. Doris, Output-feedback design for non-smooth mechanical systems: Control synthesis and experiments, Ph.D. thesis, Eindhoven University of Technology, September 2007 (hereafter referred to as the Doris publication).

The known methods and systems assume a specific frequency of stick-slip oscillations (vibrations), and tune the control system to that effect. This control strategy can fail in case the stick-slip vibrations occur at a different frequency than the expected frequency, or when there are multiple vibration frequencies, which can be changing with operating conditions.

There is a need for a more robust control method for suppressing vibrations in a drilling system.

The present invention provides a method for controlling vibrations in a drilling system, the drilling system including an elongate body extending from surface into a borehole formed in an earth formation and an associated drive system for driving the elongate body, the drive system comprising a torque controller, the method comprising the steps of:

- operating the drive system to provide a drive torque to the elongated body;
- obtaining a model of the drilling system;
- obtaining at least one input parameter for the model that relates to an uphole parameter of the drilling system;
- obtaining at least one output parameter from applying the model using the at least one input parameter, the at least one output parameter including at least one modelled downhole parameter of rotational motion;
- using the modelled downhole parameter of rotational motion in the torque controller for determining an adjustment to the drive torque to control vibrations of the elongate body.

The present invention is based on the insight gained by applicant, that a more robust control to prevent vibrations, in particular torsional vibrations such as stick-slip oscillations, is obtained when a downhole parameter of rotational motion, such as downhole rotational velocity, is used in the control of the drive torque. Known methods base the control solely on directly obtained uphole parameters such as uphole rotational velocity and/or uphole torque. Applicant has further realized that this downhole parameter of rotational motion can be obtained by applying a model of the drill string. As input to the model, at least one parameter that relates to an uphole parameter of the drilling system is used, for example an uphole parameter that is determined, measured, estimated, known or calculated as such, or a parameter that is derived from, representative of or directly related to another uphole parameter.

In one embodiment, the at least one input parameter includes at least one parameter related to an uphole torque. An example of a parameter related to uphole torque can be a torque parameter provided by a rotary drive coupled to an uphole end of the elongate body, for example as available in modern top drives. Alternatively or in addition a parameter related to uphole torque can be a torque parameter, such as torque, measured at an uphole position of the elongate body.

In one embodiment, the at least one input parameter is or comprises at least one uphole parameter of rotational motion, in particular a parameter representative of uphole angular velocity. This at least one uphole parameter of rotational motion can also be used in the torque controller for determining the adjustment to the drive torque.

In one embodiment, the method includes the step of obtaining a second input parameter for the model that relates to an estimate of one downhole angular position.

In one embodiment, at least one modelled downhole parameter of rotational motion includes a modelled downhole angular velocity of the elongate body.

In one embodiment, the at least one modelled downhole parameter includes a modelled downhole angular position of the elongate body.

In one embodiment, the at least one output parameter includes a modelled uphole angular position of the elongate body.

In one embodiment, the model is used to determine a modelled torque, and the method comprises the step of validating the model by determining that the modelled torque differs from the uphole torque by less than a predetermined value.

In one embodiment, the modelled downhole parameter is determined for a downhole position at or near a downhole end of the elongate body. The downhole end can e.g. be a drill bit or a bottom hole assembly.

In one embodiment, the at least one uphole parameter of rotational motion is determined for an uphole position at or near the surface of the earth.

Near, with respect to a downhole end, means for example within 200 m, in particular within 100 m. For example, any position in a bottom hole assembly is considered near the downhole end of the elongate body. The surface of the earth can be the bottom of the sea in for offshore wells. Near, with respect to the surface of the earth means for example within 200 m from any location between the surface of the earth and the drilling rig, which can be an offshore drilling rig at the water surface.

In one embodiment, the elongate body comprises a drill string having a drill bit at its downhole end.

The invention moreover provides a drilling system comprising a drill string having a drill bit at an uphole end;

a drive system connected to a downhole end of the drill string and adapted to provide a drive torque to the drill string;

a computer means for obtaining at least one output parameter from applying a model of the drill string using at least one input parameter for the model, the at least one input parameter including a parameter related to an uphole parameter of the elongate body, wherein the at least one output parameter includes at least one modelled downhole parameter of rotational motion, wherein the drive system comprises a torque controller, which torque controller is adapted to use the modelled downhole parameter of rotational motion for determining an adjustment to the drive torque.

The drilling system can further comprise a measurement device, e.g. for uphole torque and/or for a parameter related to uphole rotational motion.

Figure 2:
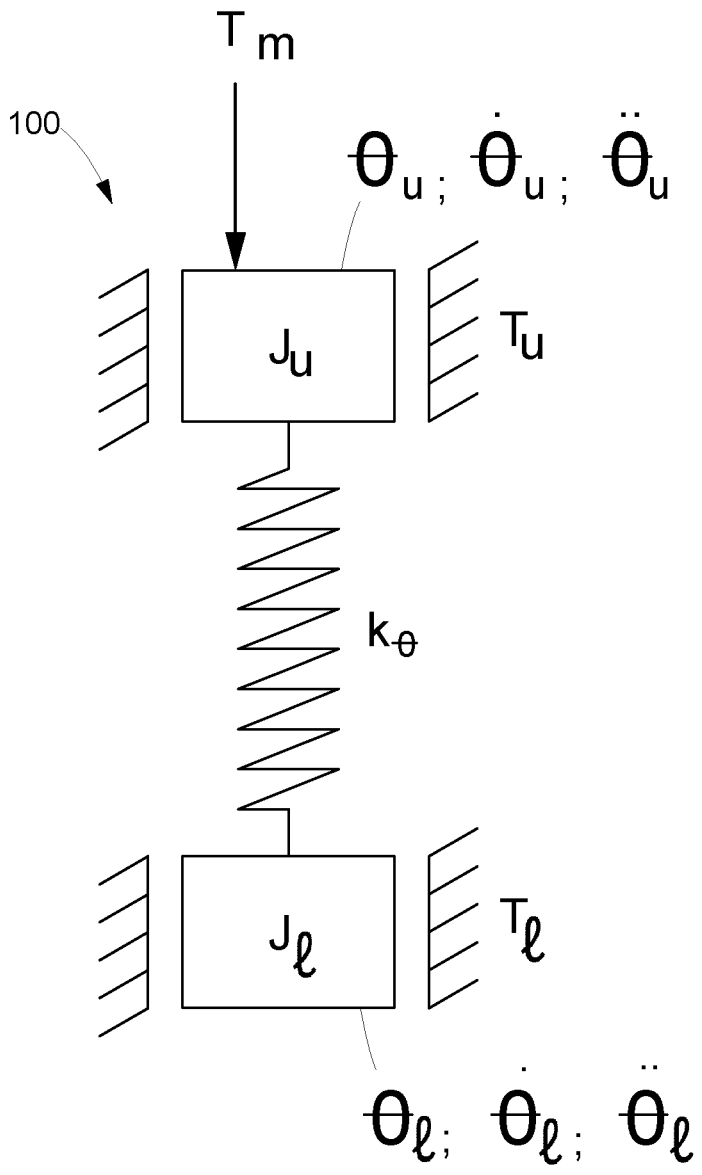

The invention will now be described by way of example in more detail, with reference to the drawings, wherein FIG. 1 shows schematically a control scheme in accordance with the present invention;

FIG. 2 shows schematically a modelled drilling system;

FIGS. 3,4*a*,4*b*,5*a*,5*b* show results from an example of a drilling system and a model thereof for various parameters.

Reference is made to FIG. 1, schematically showing an embodiment of a vibration control scheme in accordance with the present invention. The control scheme 1 is a cascade configuration. In the discussion of this figure the following parameters are used:

$T_m$: Drive torque provided by a drive system, e.g. a top drive or rotary table, to the elongate body;

V: Voltage input to a motor of the drive system;

T, $\overline{T}$: Uphole torque as determined at or near the earth's surface, and calculated by the model, respectively;

u: an update value for controlling drive torque $\theta_u$, $\theta_l$: Angular position of the elongate body at an uphole and downhole position, respectively;

$\dot{\theta}_u$, $\dot{\theta}_l$: Angular velocity of the elongate body at an uphole and downhole position, respectively;

$\ddot{\theta}_u$, $\ddot{\theta}_l$: Acceleration of the elongate body at an uphole and downhole position, respectively;

$\overline{\theta}_u$, $\dot{\overline{\theta}}_u$, $\ddot{\overline{\theta}}_u$: modelled uphole parameters of rotational motion, i.e. model estimate for angular position, angular velocity and acceleration of the elongate body at an uphole position, respectively;

$\overline{\theta}_l$, $\dot{\overline{\theta}}_l$, $\ddot{\overline{\theta}}_l$: modelled downhole parameters of rotational motion, i.e. model estimate for angular position, angular velocity and acceleration of the elongate body at a downhole position, respectively.

Generally, the index "u" ("upper") refers to an uphole position, preferably at or near the surface of the earth, and the index "l" refers to a downhole position, preferably at or near the downhole end of the elongate body. A bar above a symbol indicates a modelled parameter. A dot above a symbol refers to a single time derivative, i.e. a single dot indicates a velocity, and a double dot indicates an acceleration. The subscript eq will be used to refer to an equilibrium value, that is a value for a state in which the system is free of vibrations.

Angular velocity is also referred to as rotational velocity.

In FIG. 1 the elongate body, drill string system 10 extending downwardly from an uphole position such as the earth's surface into a borehole, is driven via 15 by a drive system, motor 30, creating a drive torque $T_m$ for driving the drill string. The motor 30 is controlled via 35 by a controller 50.

The drive system generally includes a rotary table or a top drive, and the drill string typically includes a lower end part of increased weight, i.e. the bottom hole assembly (BHA) which provides the necessary weight on bit during drilling.

By a top drive is meant a drive system which drives the drill string in rotation at its upper end, i.e. close to where the string is suspended from the drilling rig.

Uphole parameters of the drill string system are determined such as at surface, and used in the control scheme.

One uphole parameter relates to uphole torque. The actual uphole torque in the upper part of the drill string is T. In the practice of the invention, the torque $T_m$ applied in a modern drive, which is often a top drive, or a parameter directly related to $T_m$, is often available as a digital parameter. For a top drive, directly connected to a the upper end of the drill string, T and $T_m$, do not typically differ much, and can in first approximation be regarded equal. A minor order difference can occur from friction in the drive itself, and from higher-frequency contributions that may not be transmitted between drive and drill string. In a rotary table drive there can be a difference due to transmission losses. In any event, an uphole torque T or a parameter directly related to this torque can be determined for example by measuring, e.g. by a torque sensor at a location at or near the surface.

Further uphole parameters can be measured by suitable sensors. In this embodiment, uphole velocity $\dot{\theta}_u$ or a parameter representative thereof is also be measured by a sensor at or near surface. A parameter related to uphole velocity is for example a period of one rotation at an uphole position. The period of rotation is directly related to and representative of velocity.

The control scheme also uses a modelling of the drilling system. The model is indicated as 70 in FIG. 1, and is typically implemented in a computer system running software, e.g. written in Matlab. It is known in the art how to build a model for a given drill string, and for the drill string in the borehole. The model can be a simple two degree-of-freedom (DOF) model, e.g. similar to the one used in section 6.2.2. of the Doris publication. The model can also be a more complex multi-degree-of freedom model. It is also possible to derive a 2-DOF model from a multi-DOF model using model reduction techniques known per se. The skilled person knows how to build a model that describes the dynamics of a specific drill system accurately enough for the controller needs, by including sufficient eigen-modes of the drill system.

The model 7 receives one or more uphole parameters of the drilling system or the elongate body, via 45. In this embodiment $\dot{\theta}_u$ is used in this embodiment as input parameters to a model of the drill-string system, together with $\overline{\theta}_l(t_0)$. $\overline{\theta}_l(t_0)$ is an estimate of the bottom hole assembly angular position at the moment the controller starts to operate. A torque parameter can also be used as input in the model, e.g. $T_m$ transmitted via 55.

The model of the drill-string system can calculate downhole parameters of rotational motion, e.g. $\overline{\theta}_l$ and/or $\ddot{\overline{\theta}}_l$, and optionally further uphole and downhole parameters of the drilling system, such as parameters of rotational motion $\overline{\theta}_u$, $\overline{\theta}_{eq}$, $\overline{\theta}_{u,eq}$, $\overline{\theta}_{l,eq}$. Some or all of these parameters are sent to the controller 7, via 75, where they are processed, e.g. in a multiplication routine, with a controller gain. In one embodiment $\dot{\theta}_u$ is also used as input for the controller, via 25. The controller gain can for example be determined as in section 6.3.3. of the Doris publication. Based on the input received from controller 5, the motor changes $T_m$ by a differential value –u and supplies it to the drill-string system 1, in order to suppress vibrations.

Suitably the model is also used to determine a modelled torque $\overline{T}$, which sent via 82 to comparator 90, where it is compared with the torque T (received via 84), that was determined as an uphole parameter. If the difference is small, say below 10% of the uphole torque T, than the model is validated, otherwise it is updated (indicated by 86) until a better agreement is found.

EXAMPLE

With reference to FIG. 2, a 2-DOF model of a drill system 100 will be discussed. This system consists of two inertias ($J_u$,$J_l$), a spring flexibility $k_\theta$, two frictional torques ($T_u$,$T_l$) and a drive torque from the drive system, typically including an electrical motor ($T_m$). $J_u$ is the inertia of the drive system, e.g. top drive, and an upper part of the drill-string, $J_l$ is the inertia of the Bottom-Hole-Assembly (BHA) and the remaining part of the drill-string. $k_\theta$ is the drill-pipe stiffness, $T_u$ describes the torque resistance in torsional motion of the upper part of the drill-string (electrostatic forces in the motor, friction in the ball bearings, etc.) and $T_l$ describes the interaction of the BHA with the surrounding earth formation and the drilling mud in the drill string and borehole.

Two sets of differential equations describing the torsional dynamics of this system are considered. Equations (1)-(8) are assumed to exactly represent the drill-string system, and are considered as the real system in this example. A model will normally deviate from the real system. Therefore in equations (9), (10) some disturbances are added to $k_\theta$, $J_l$ and $T_l$ in order to simulate modelling inaccuracies. The disturbance values are generally below 10% of the base value.

The following equations (1)-(8) describe the dynamics of the drill system depicted in FIG. 2.

$$J_u \cdot \ddot{\theta}_u + k_\theta \cdot (\theta_u - \theta_l) + T_u(\dot{\theta}_u) - T_m = 0 \tag{1}$$

$$J_l \cdot \ddot{\theta}_l + k_\theta \cdot (\theta_u - \theta_l) + T_l(\dot{\theta}_l) = 0 \tag{2}$$

$$T_u(\dot{\theta}_u) \in \begin{cases} T_{cu}(\dot{\theta}_u) \cdot \mathrm{sgn}(\dot{\theta}_u) \text{ for } \dot{\theta}_u \neq 0 & (3) \\ [-T_{su} + \Delta T_{su},\ T_{su} + \Delta T_{su}] \text{ for } \dot{\theta}_u = 0 & (4) \end{cases}$$

$$T_{cu}(\dot{\theta}_u) = T_{su} + \Delta T_{su} \cdot \mathrm{sgn}(\dot{\theta}_u) + b_u \cdot |\dot{\theta}_u| + \Delta b_u \cdot \dot{\theta}_u \tag{5}$$

$$T_l(\dot{\theta}_l) \in \begin{cases} T_{cl}(\dot{\theta}_l) \cdot \mathrm{sgn}(\dot{\theta}_l) \text{ for } \dot{\theta}_l \neq 0 & (6) \\ [-T_{sl},\ T_{sl}] \text{ for } \dot{\theta}_l = 0 & (7) \end{cases}$$

$$T_{cl}(\dot{\theta}_l) = T_{sl} + (T_{sl} - T_{cl}) \cdot e^{-\left|\frac{\dot{\theta}_l}{\omega_{sl}}\right|\delta_{sl}} + b_l \cdot |\dot{\theta}_l|. \tag{8}$$

As a model simulation of the drill system depicted in FIG. 2, the following equations (9) and (10) are used instead of (1) and (2).

$$J_u \cdot \ddot{\overline{\theta}}_u + k_{\theta m} \cdot (\overline{\theta}_u - \overline{\theta}_l) + T_u(\dot{\overline{\theta}}_u) - T_m = 0 \tag{9}$$

$$J_{lm} \cdot \ddot{\overline{\theta}}_l - k_{\theta m} \cdot (\overline{\theta}_u - \overline{\theta}_l) + T_m(\dot{\overline{\theta}}_l) = 0 \tag{10}$$

The parameters in these equations (9, 10) are in principle as in equations (3)-(8). $T_{lm}$ has the same structure as $T_l$, i.e. is described by equations (6)-(8), but $T_{clm}$ replaces $T_{cl}$ and $b_{lm}$ replaces $b_l$ in these equations.

When $\dot{\theta}_u$ is known such as from surface measurements one can substitute $\dot{\overline{\theta}}_u$ with $\dot{\theta}_u$ in (9) and (10). Therefore (9) takes the following form:

$$J_u \cdot \ddot{\overline{\theta}}_u + k_{\theta m} \cdot (\theta_u - \overline{\theta}_l) + T_u(\dot{\theta}_u) - T_m = 0 \tag{11}$$

$$J_{lm} \cdot \ddot{\overline{\theta}}_l - k_{\theta m} \cdot (\theta_u - \overline{\theta}_l) + T_{lm}(\dot{\overline{\theta}}_l) = 0 \tag{12}$$

Moreover, due to the fact that the uphole torque T is known or measured $$T = k_\theta \cdot (\theta_u - \theta_l) \tag{13}$$

it can be compared with the model calculated torque $$\overline{T} = k_{\theta m} \cdot (\overline{\theta}_u - \overline{\theta}_l) \tag{14}$$

in order to validate whether the model is able to describe the dynamics of the drill-string system sufficiently accurate. If the difference between $\overline{T}$ and T is bigger than a predetermined value, e.g. 10% of T, then the model parameters are suitably further optimized, until a good match between the model value and the actual value for the drill system.

Calculations were performed using Matlab software for solving the equations. The values of the parameters of the drill-string system and its model are given in Table 1.

Figure 3:
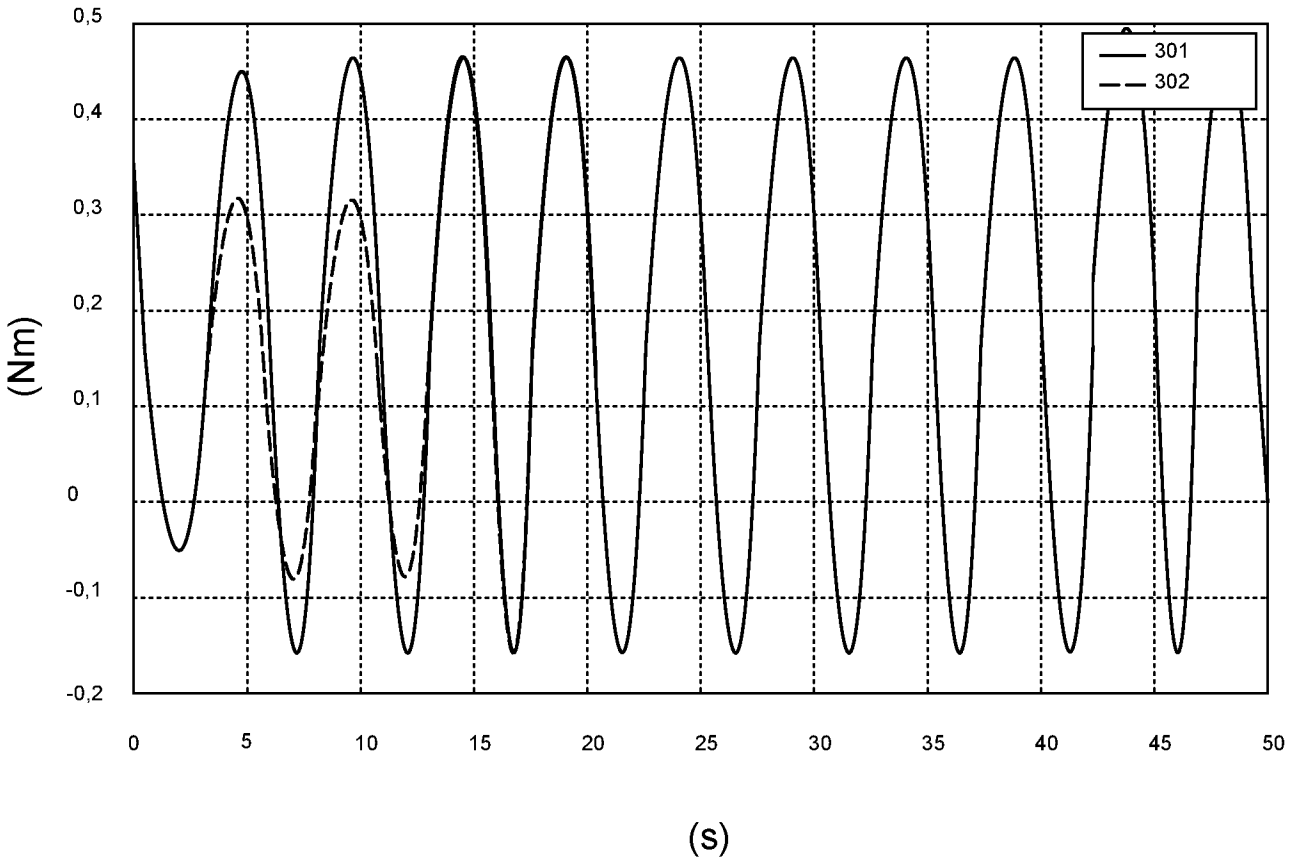
Figure 4A:
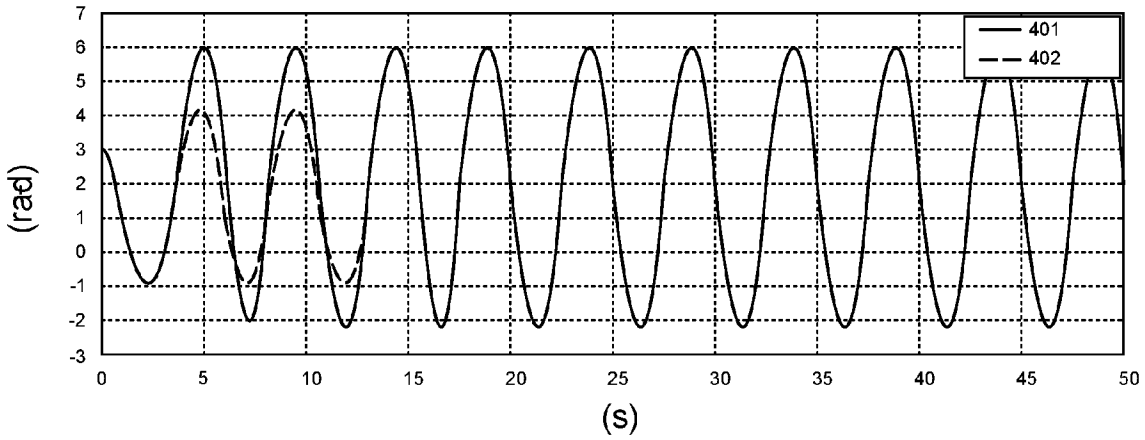
Figure 4B:
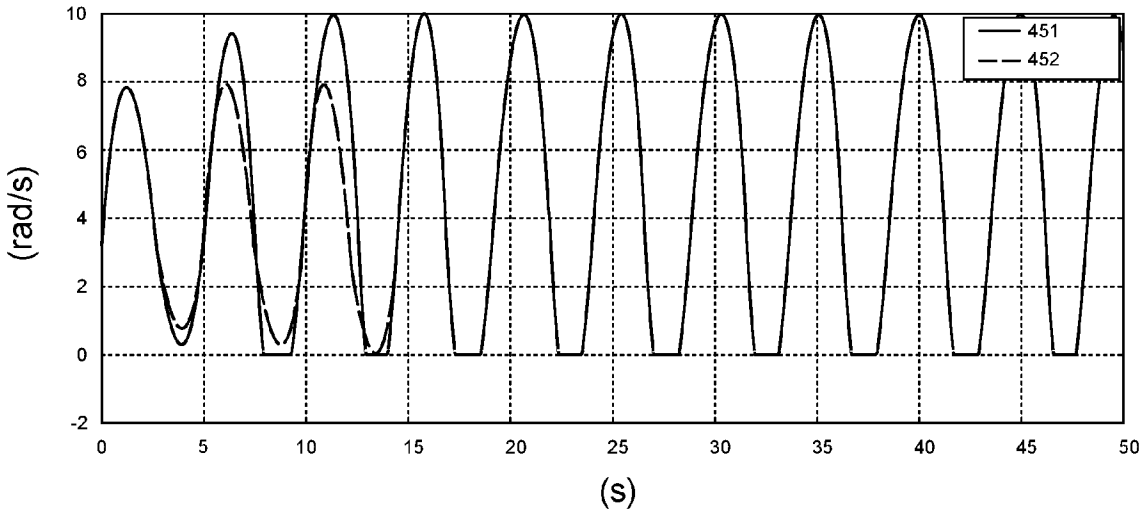

FIG. 3 show the results of the example for the uphole torque T (301) and the modelled uphole torque $\overline{T}$ (302) as a function of time, respectively. The Figure shows that T and $\overline{T}$ match very well when using $\dot{\overline{\theta}}_u=\dot{\theta}_u$ in the model.

Moreover, in FIGS. 4(*a*) and 4(*b*) the time history of $\theta_u-\theta_l$ (401), $\theta_u-\overline{\theta}_l$, (402), $\dot{\theta}_l$ (451) and $\dot{\overline{\theta}}_l$ (452) is depicted. These Figures show that $\theta_u-\theta_l$ matches very well with $\theta_i-\overline{\theta}_l$, and $\dot{\theta}_l$ with $\dot{\overline{\theta}}_l$. The stick-slip behaviour is clearly visible. In practice, the downhole angular velocity $\dot{\theta}_l$ is not normally available. It is discussed and shown here merely to validate the ability of the model to reconstruct the full torsional dynamics of the drill-string system, but is not required in practicing the invention.

In accordance with the invention an adjustment to the drive torque is applied for torque control so as to control vibrations. The adjustment takes the following form in this example:

$$u=-k_1\cdot[\overline{\theta}_u-\overline{\theta}_l-(\overline{\theta}_{u,eq}-\overline{\theta}_{l,eq})]-k_2\cdot[\dot{\theta}_u-\dot{\theta}_{u,eq})]-k_3\cdot[\overline{\theta}_l-\theta_{l,eq}] \quad (15)$$

where the subscript eq refers herein to equilibrium values of the model and the drill-string system. The adjustment u is calculated using modelled downhole parameters of rotational motion. $\dot{\theta}_{u,eq}$ and $\dot{\theta}_{l,eq}$ are equal and they are the desired values of the drill-string system while drilling because no stick-slip vibrations occur when they are equal. In order to calculate $\overline{\theta}_{u,eq},\overline{\theta}_{l,eq}$ we nullify the acceleration component in eq. (11), (12), we substitute $\dot{d}_u=\dot{\theta}_{u,eq},\dot{\overline{\theta}}_l=\dot{\theta}_{l,eq}$ and we solve again the equations (11), (12). $k_1$, $k_2$, $k_3$ are constants calculated according to the control theory of the Doris publication using the model (11), (12). Their values are given in Table 1. The total torque applied to the drill-string system is:

$$T_{total}=T_m-u \quad (16)$$

This torque is used in (1) instead of $T_m$.

Figure 5A:
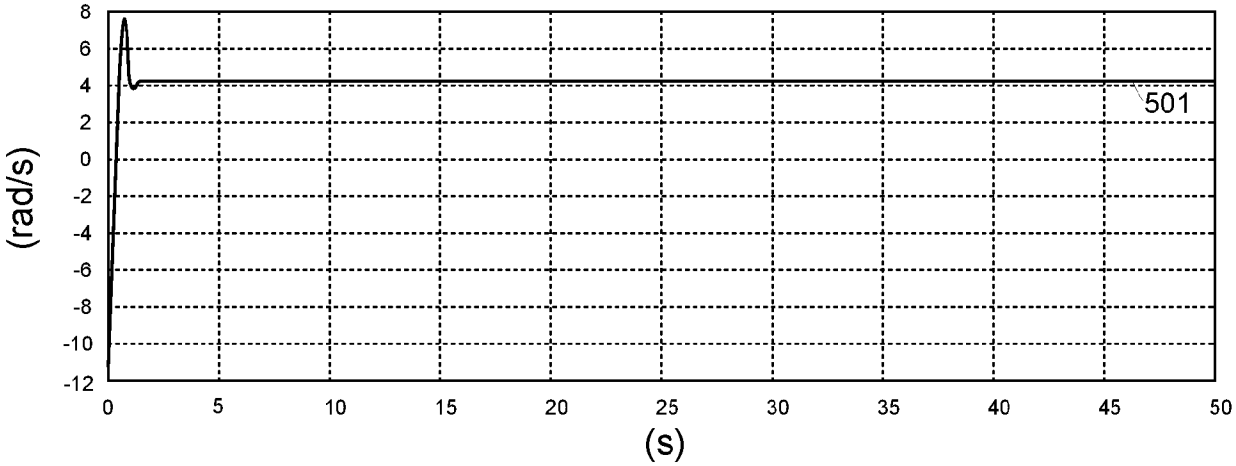
Figure 5B:
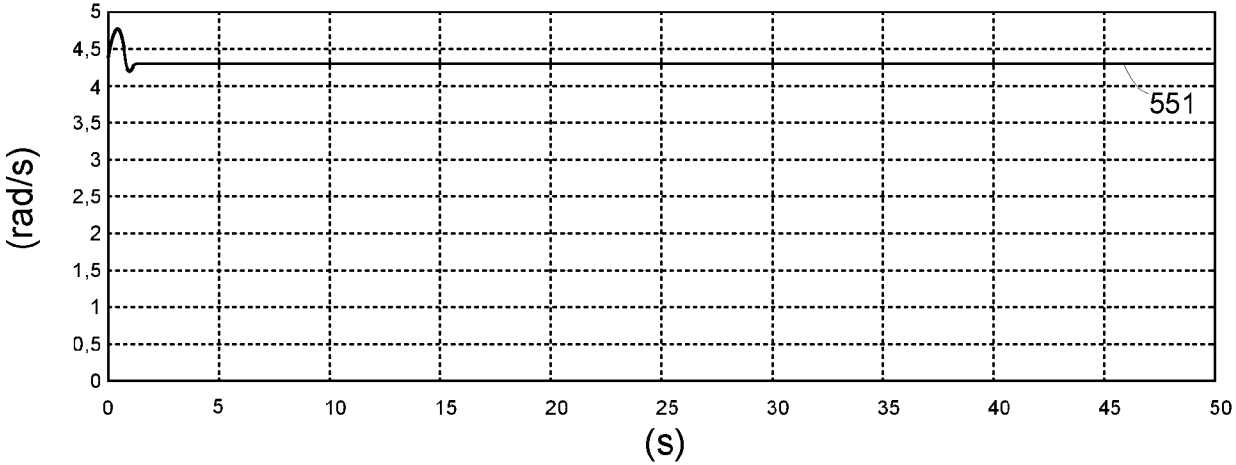

In FIGS. 5*a* and 5*b*, closed-loop results of $\dot{\theta}_u$ (501) and $\dot{\theta}_i$ (551) are presented, i.e. when the controller is included in the calculations according to equation 14. This Figure demonstrates, that the control loop is able to eliminate the stick-slip BHA vibrations of the drill-string system. Note that the controller is able to eliminate stick-slip vibrations for very low RPM (rotations per minute), which is an advantage over known stick-slip suppression methods and has great practical significance for oil-field drilling systems.

The present invention is not limited to the above described embodiments thereof, wherein many modifications are conceivable within the scope of the appended claims. Features of respective embodiments may for instance be combined.

TABLE 1

| | Parameter | Value | Unit |
|---|---|---|---|
| Drill-string system | $J_u$ | 0.4765 | kg · m$^2$ |
| | $J_l$ | 0.0414 | kg · m$^2$ |
| | $T_{su}$ | 0.37975 | N · m |
| | $\Delta T_{su}$ | −0.00575 | N · m |
| | $b_u$ | 2.4245 | kg · m$^2$/rad · s |
| | $\Delta b_u$ | −0.0084 | kg · m$^2$/rad · s |
| | $k_\theta$ | 0.0775 | N · m/rad |
| | $T_{sl}$ | 0.2781 | N · m |
| | $T_{cl}$ | 0.0473 | N · m |
| | $\omega_{st}$ | 1.4302 | rad/sec |
| | $\delta_{st}$ | 2.0575 | [—] |
| | $b_l$ | 0.0105 | kg · m$^2$/rad · s |
| Model | $k_{\theta m}$ | 0.0787 | N · m/rad |
| | $J_{lm}$ | 0.0430 | kg · m$^2$ |
| | $T_{clm}$ | 0.0491 | N · m |
| | $b_{lm}$ | 0.0109 | kg · m$^2$/rad · s |
| Controller | $k_1$ | 14.5 | N · m/rad |
| | $k_2$ | 1.5 | N · m · sec/rad |
| | $k_3$ | 30 | N · m · sec/rad |

That which is claimed is:

1. A method for controlling vibrations in a drilling system, the drilling system including an elongate body extending from surface into a borehole formed in an earth formation and an associated drive system for driving the elongate body, the drive system comprising a torque controller, the method comprising the steps of:

operating the drive system to provide a drive torque to the elongated body;

obtaining a model of the drilling system;

obtaining at least one input parameter for the model that relates to an uphole parameter of the drilling system;

obtaining at least one output parameter from applying the model using the at least one input parameter, the at least one output parameter including at least one modelled downhole parameter of rotational motion;

using the modelled downhole parameter of rotational motion in the torque controller for determining an adjustment to the drive torque to control vibrations of the elongate body;

wherein the model is used to determine a modelled torque, and wherein the method comprises the step of validating the model by determining that the modelled torque differs from the uphole torque by less than a predetermined value.

2. The method according to claim 1, wherein the at least one input parameter includes at least one parameter related to an uphole torque.

3. The method according to claim 2, wherein the at least one parameter related to uphole torque is or comprises a torque parameter provided by a rotary drive coupled to an uphole end of the elongate body.

4. The method according to claim 2, wherein the at least one parameter related to uphole torque is or comprises a torque parameter measured at an uphole position of the elongate body.

5. The method according to claim 1, wherein the at least one input parameter includes at least one uphole parameter of rotational motion.

6. The method according to claim 5, wherein the at least one uphole parameter of rotational motion includes a parameter representative of uphole angular velocity.

7. The method according to any one of claims 5, wherein the at least one uphole parameter of rotational motion is also used in the torque controller for determining the adjustment to the drive torque.

8. The method according to claim 1, including the step of obtaining a second input parameter for the model that relates to an estimate of one downhole angular position.

9. The method according to claim 1, wherein the at least one modelled downhole parameter of rotational motion includes a modelled downhole angular velocity of the elongate body.

10. The method according to claim 1, wherein the at least one modelled downhole parameter includes a modelled downhole angular position of the elongate body.

11. The method according to claim 1, wherein the modelled downhole parameter is determined for a downhole position at or near a downhole end of the elongate body.

12. The method according to any claim 1, wherein the at least one uphole parameter is determined for an uphole position at or near the surface of the earth.

13. The method according to claim 1, wherein the elongate body comprises a drill string having a drill bit at a downhole end of the elongate body.

* * * * *